United States Patent [19]

Fanning et al.

[11] Patent Number: 4,855,964

[45] Date of Patent: Aug. 8, 1989

[54] VENTED-PIPE PROJECTOR

[75] Inventors: Bryce L. Fanning; Garfield W. McMahon, both of Dartmouth, Canada

[73] Assignee: Her Majesty the Queen in Right of Canada, as represented by the Minister of National Defence of Her Majesty's Canadian Government, Ontario, Canada

[21] Appl. No.: 216,504

[22] Filed: Jul. 8, 1988

[51] Int. Cl.[4] ..... H04R 17/00

[52] U.S. Cl. ..... 367/159; 367/162; 367/166; 310/337

[58] Field of Search ..... 367/157, 159, 162, 165, 367/166, 167, 171, 172, 176; 310/337, 321, 323, 328, 334; 181/402

[56] References Cited

U.S. PATENT DOCUMENTS

| | | | |
|---|---|---|---|
| 4,156,824 | 5/1979 | Pence | 310/337 |
| 4,524,693 | 6/1985 | McMahon et al. | 367/167 |
| 4,706,229 | 11/1987 | Congdon | 367/159 |

OTHER PUBLICATIONS

J. B. Lee, "Low-Frequency Resonant-Tube for Underwater Sound" Defence Research Establishment Atlantic, Dartmouth, Nova Scotia, vol. 2, pp. 10–15.

*Primary Examiner*—Deborah L. Kyle
*Assistant Examiner*—J. Woodrow Eldred
*Attorney, Agent, or Firm*—Nixon & Vanderhye

[57] ABSTRACT

A piezoelectrically-driven, resonant-pipe projector has formed therein vents to broaden the response of certain cavities resonances and to increase the response between these resonances. The projector exhibits a relatively high electroacoustical efficiency, is capable of medium to high power output over the operating band, and is not depth dependent or depth limited.

9 Claims, 3 Drawing Sheets

VENTED-PIPE PROJECTOR

FIELD OF THE INVENTION

The present invention relates to underwater sound projectors, and more particularly, to free-flooding piezoelectric ceramic tubes used as such.

BACKGROUND OF THE INVENTION

Moderate power, broadband projectors find application in deep-towed seismic profiling and underwater acoustics research. Current projectors make use of hydraulic or pneumatic devices, electric spark sources, and electromagnetic devices. Free-flooding piezoelectric ceramic tubes are often employed as drivers for underwater sound projectors because their characteristics are essentially unaffected by depth; the use of such tubes as projectors has been described in a paper by J.B. Lee entitled "Low-Frequency Resonant-Tube Projector For Underwater Sound," presented at the OCEANS '74 conference.

Short tubes, or rings, in which the fundamental cavity mode is closely coupled to the ceramic ring mode, can deliver high acoustic power over a wide frequency band. However, because the power output of a simple acoustic source is proportional to the squares of volume velocity and frequency, projectors at low frequency often depend on large vibrating areas in order to achieve reasonable power outputs; thus, even for some low frequency applications that require only moderate power, the projector can become unacceptably large and expensive. Long tubes, or pipes, on the other hand, exhibit a number of narrow-band cavity resonances at which low frequency sound is radiated efficiently, but the output is usually negligible between these resonances. Decreasing the response of certain resonances and increasing the response between certain other resonances enables a piezoelectric ceramic tube to be used over a wide band of frequencies, while retaining the advantages of a relatively high electrical-to-acoustical efficiency, a medium to high power output over the operating frequency band, and the absence of depth dependency and depth limitations.

SUMMARY OF THE PRESENT INVENTION

The present invention relates to a free-flooding, piezoelectrically-driven pipe projector in which vent holes are introduced in the pipe walls to decrease the response of certain cavity resonances and to increase the response between certain other cavity resonances.

More particularly, the present invention relates to a resonant-pipe projector, comprising a hollow, open-ended, substantially cylindrical central section having electroacoustical means for driving the projector; a pair of hollow, open-ended, substantially cylindrical tubular sections, one end of each of the tubular sections being attached to an end of the central section; the tubular sections having openings formed in the cylindrical walls thereof.

The present invention also relates to a resonant-pipe projector, comprising a hollow, open-ended, substantially cylindrical tubular section; electroacoustical means located substantially at the center of the tubular section, for driving the projector; the tubular section having openings formed in the cylindrical walls thereof.

BRIEF DESCRIPTION OF THE DRAWINGS

A preferred embodiment of the present invention will now be described in conjunction with the attached drawings, in which.

DETAILED DESCRIPTION OF THE PREFERRED EMBODIMENT

Figure 1:
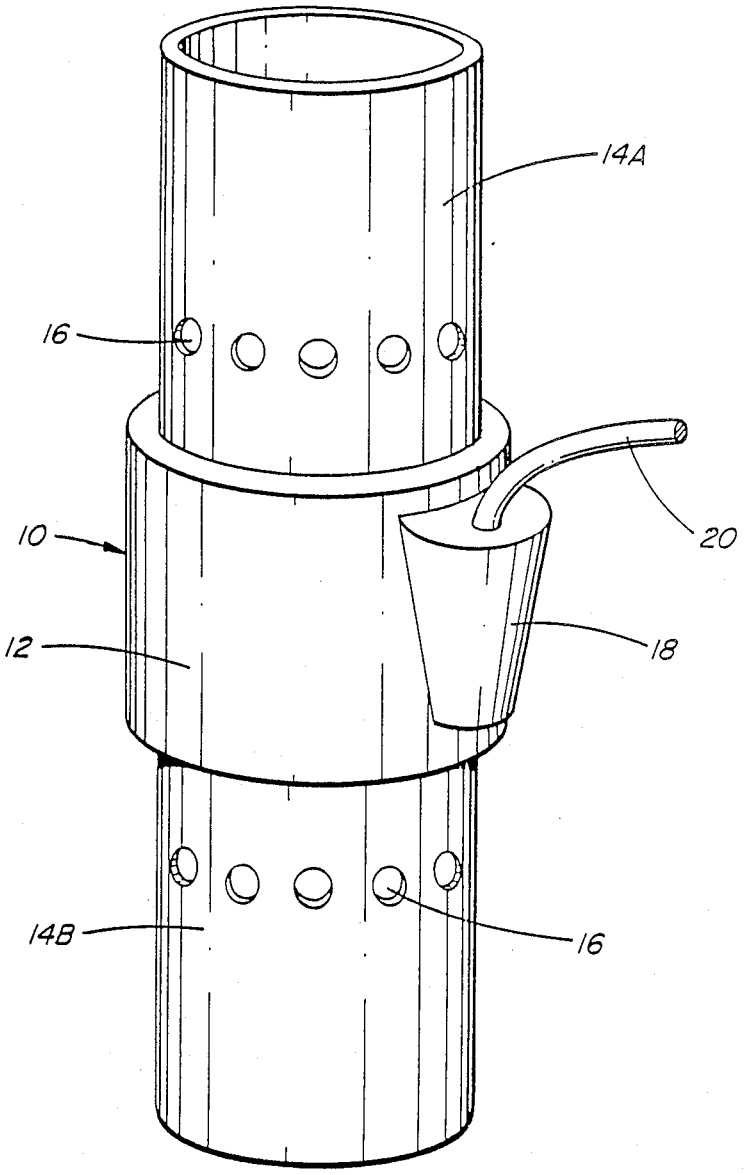
FIG. 1 depicts the vented resonant-pipe projector of the present invention.
Figure 2:
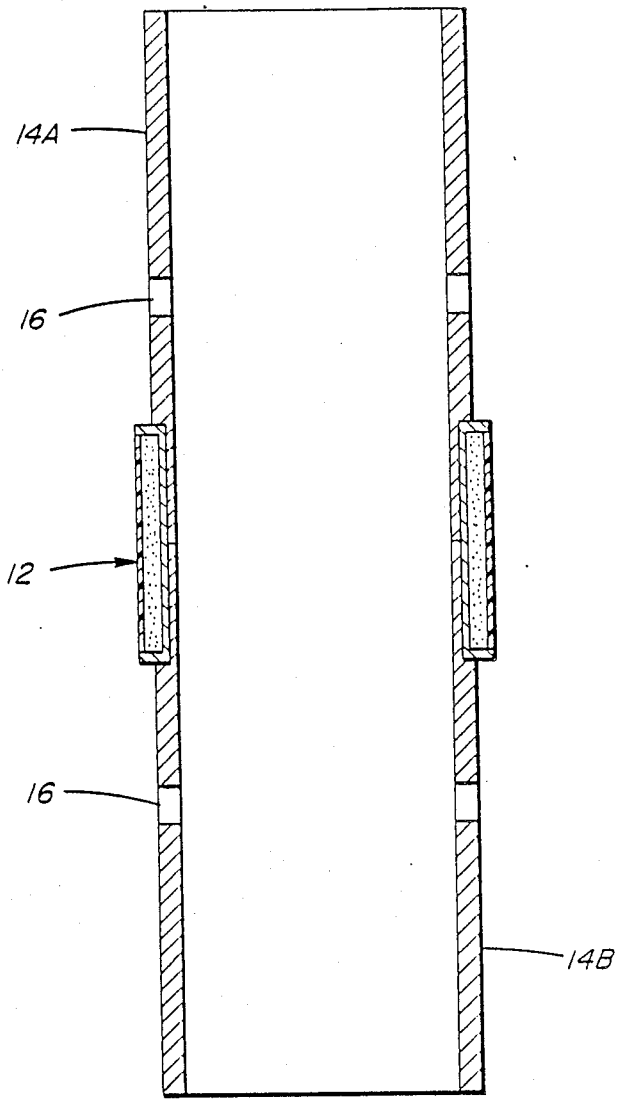
FIG. 2 depicts a cross-sectional view of the projector of FIG. 1.

Referring to FIGS. 1 and 2, a vented resonant-pipe projector shown generally as 10 comprises a cylindrical piezoelectric ceramic driver unit 12 which accommodates two open aluminum pipes 14A and 14B bonded thereto at the ends thereof. In the preferred embodiment, pipes 14 have an outside diameter of 10.1 cm and a wall thickness of 0.63 cm, the overall length of projector 10 being 36 cm. The pipes are vented by a circumferentially-distributed series of holes 16 which are formed, by, for example, drilling, in each of pipes 14A and 14B so as to maximize the transmitting response between the two lower cavity resonances, while preserving at least a one-octave usable bandwidth. Holes 16 have a diameter of 13 mm and are located 8.4 cm from the center of projector 10. The selection of the diameters for holes 16, and the placement of holes 16 on pipes 14, is based on a numerical finite-element analysis or on empirical testing. An electrical cable 20, which supplies power to driver unit 12, is attached to driver unit 12 by an epoxy boss 18.

Figure 3:
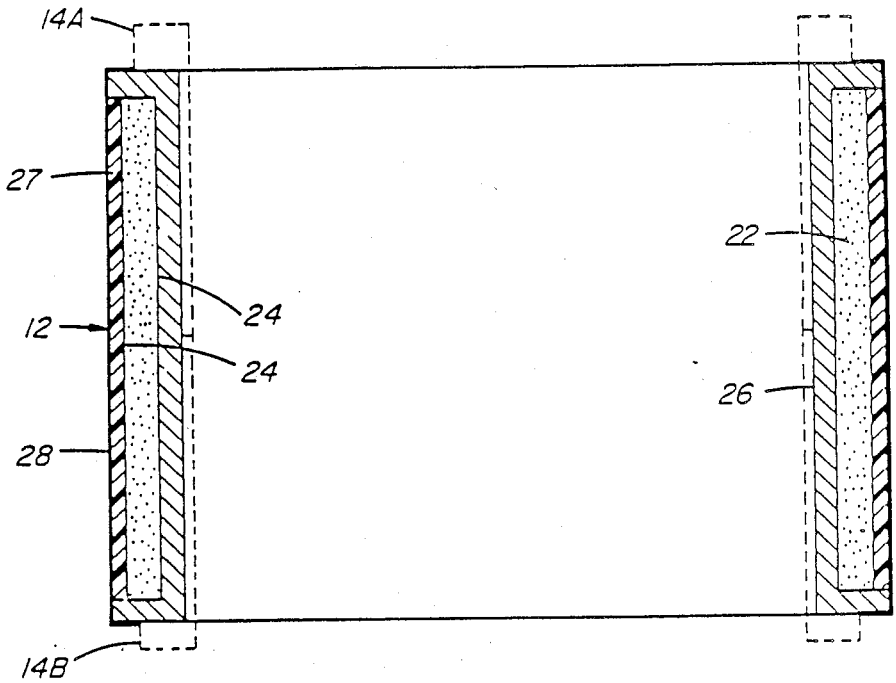
FIG. 3 depicts a cross-sectional view of the piezoelectric driver for the projector of FIG. 1.

FIG. 3 is a cross-sectional diagram depicting driver unit 12 in greater detail. Driver unit 12 consists of a radially-poled lead zirconate-titanate cylinder 22, with a pair of silver electrodes 24, cylinder 22 having an outside diameter of 10.8 cm, a wall thickness of 0.51 cm, and a length of 7.0 cm. Cylinder 22 can be pre-stressed with fiberglass roving 27 wound under tension and consolidated with epoxy resin. Thin portions of aluminum pipes 14 extend into the center of driver unit 12, and mechanical coupling between cylinder 22 and pipes 14 is effected with a filled-epoxy casting resin 26. Driver unit 12 is made substantially waterproof by means of an external layer 28, which can comprise several painted coats of neoprene.

Figure 4:
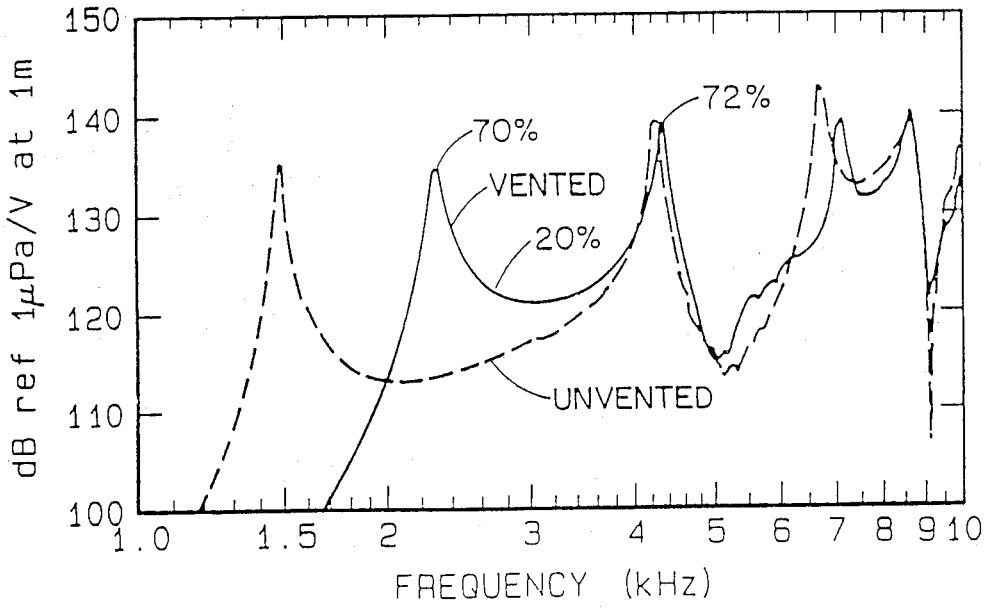
FIG. 4 is a diagram showing the projector response curves for the vented projector depicted in FIG. 1 and a comparable unvented projector.

FIG. 4 depicts, with a broken line, the projector response curve for an unvented projector of dimension equal to that of projector 10, and, with the solid line, the projector response curve for vented projector 10 of the present invention. It is seen that vents 16 broaden the response of the first resonance and shift it upwards from 1450 Hz to 2400 Hz. The response of the shifted first resonance is reduced by approximately 1 dB. The second resonance is shifted from 4200 Hz to 4400 Hz and its response is also reduced by about 1 dB. The minimum response between the first and second resonances of vented projector 10 is about 9 dB higher than that for the comparable unvented projector. Electrical-to-acoustical efficiences at several frequencies for vented pipe projector 10 are depicted, and are seen to be much higher than those of the devices currently in use, varying between 20% and 72% over the band from 2200 Hz to 4600 Hz. As well, efficient output is seen to be available in a band that includes the two higher overtones at 7100 Hz and 8700 Hz.

Because of its free-flooding construction, resonant pipe projector 10 of the present operation can operate at great depths, with essentially no change in performance. It may, however, be limited at shallow depths due to cavitation; a pressure "hot-spot" at the surface of driver 12 may cause cavitation to occur when the ambient pressure is less than the peak acoustic pressure.

The vented pipe projector of the present invention is well suited to applications that require wide angle or omni-directional radiation perpendicular to the projector axis. For example, the projector may be used as a source for seismic exploration, being towed horizontally near the bottom for sub-bottom profiling. Under tow, the water can simply flow through the projector, or, if high speed towing is required, the projector can be housed in a streamlined tow body. Alternatively, the projector can be suspended vertically, for use in applications relating to communications, training, and sonar research, where omni-directional coverage in azimuth is required.

The response by projector 10 herewith described varies about 18 dB over the band of interest. In some applications, such as sub-bottom profiling, which require a short, broadband pulse, a precompensated driving waveform can be used to control the spectrum of the acoustic output. This can also be accomplished using post-compensation or matched filter techniques, in a manner known to persons skilled in the art.

Vented resonant pipe projector 10 herewith described makes use of radially-poled ceramic cylinder 22 as the driver. In another embodiment, a tangentially-poled ceramic cylinder could be used, so that 6 dB more output power would normally be available from a unit of approximately the same size and weight. If tangential poling and a driving field of 2 kV/cm is assumed for the ceramic cylinder, then the source levels available at 2350, 3500, and 4350 Hz are, respectively, 201, 187, and 205 dB re 1 uPa at 1 m. Of course, the design herewith disclosed is readily scaled up or down for frequency, inversely with size.

The foregoing has shown and described particular embodiments of the invention, and further variations thereof will be obvious to one skilled in the art. Accordingly, the embodiments are to be taken as illustrative rather than limitative, and the true scope of the invention is as set out in the appended claims.

The embodiments of the invention in which an exclusive property or privilege is claimed are defined as follows:

1. A resonant-pipe projector, comprising:

a hollow, open-ended, substantially cylindrical central section having electroacoustical means for driving said projector; and a pair of hollow, open-ended substantially cylindrical tubular sections, one end of each of said tubular sections being attached to an end of said central section;

each of said tubular sections having a single row of circumferentially-distributed vents formed in the cylindrical walls thereof.

2. The projector of claim 1, wherein said vents are substantially circular in shape.

3. The projector of claim 1, wherein said electroacoustical means for driving said projector comprises a piezoelectric ceramic cylinder.

4. The projector of claim 3, wherein said piezoelectric ceramic cylinder includes a radially-poled lead zirconate-titanate ceramic.

5. The projector of claim 3, wherein said piezoelectric ceramic cylinder includes a tangentially-poled lead zirconate-titanate ceramic.

6. A resonant-pipe projector, comprising:

a hollow, open-ended, substantially cylindrical tubular section; and electroacoustical means located substantially at the center of said tubular section, for driving said projector;

each said tubular section having a single row of circumferentially-distributed vents formed in the cylindrical walls thereof.

7. The projector of claim 6, wherein said vents are substantially circular in shape.

8. The projector of claim 7, wherein said electroacoustical means for driving said projector comprises a piezoelectric ceramic cylinder.

9. The projector of claim 1, wherein each said tubular section has an outside diameter of 10.1 cm, a wall thickness of 0.63 cm and wherein said vents have a diameter of 13 mm and are located 8.4 cm from a transverse plane extending centrally through said projector.

* * * * *